US007650751B2

(12) United States Patent
Tanaka

(10) Patent No.: US 7,650,751 B2
(45) Date of Patent: Jan. 26, 2010

(54) STIRLING ENGINE

(75) Inventor: Shohzoh Tanaka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 11/596,435

(22) PCT Filed: Mar. 29, 2005

(86) PCT No.: PCT/JP2005/005826

§ 371 (c)(1),
(2), (4) Date: Nov. 14, 2006

(87) PCT Pub. No.: WO2005/119138

PCT Pub. Date: Dec. 15, 2005

(65) Prior Publication Data

US 2007/0277521 A1 Dec. 6, 2007

(30) Foreign Application Priority Data

Jun. 3, 2004 (JP) ..... 2004-165324

(51) Int. Cl.
*F01B 29/10* (2006.01)

(52) U.S. Cl. ..... 60/517

(58) Field of Classification Search ..... 60/517–526
See application file for complete search history.

(56) References Cited

U.S. PATENT DOCUMENTS

| | | | | |
|---|---|---|---|---|
| 3,496,720 | A * | 2/1970 | Meijer et al. | 60/521 |
| 3,928,974 | A * | 12/1975 | Benson | 60/650 |
| 4,792,289 | A * | 12/1988 | Nieratschker | 417/259 |
| 2002/0014069 | A1 * | 2/2002 | Holtzapple et al. | 60/39.63 |

FOREIGN PATENT DOCUMENTS

| | | | |
|---|---|---|---|
| JP | 5-312425 | A | 11/1993 |
| JP | 11-173697 | A | 7/1999 |
| JP | 2003-75005 | A | 3/2003 |
| JP | 2004-52866 | A | 2/2004 |

* cited by examiner

*Primary Examiner*—Hoang M Nguyen
(74) *Attorney, Agent, or Firm*—Birch, Stewart, Kolasch & Birch, LLP

(57) ABSTRACT

A Stirling engine is provided with a piston and a displacer. When the piston is made to reciprocate inside a cylinder by a linear motor, the displacer reciprocates inside a cylinder with a predetermined phase difference relative to the piston. In parts of the displacer and the cylinder that receives the displacer, the parts facing a compression space are made of metal, and the parts facing an expansion space are made of a low-thermal-conductivity material. In the metal part, the fitting accuracy is defined.

7 Claims, 3 Drawing Sheets

STIRLING ENGINE

BACKGROUND OF THE INVENTION

1. Field of the Invention

The present invention relates to a Stirling engine.

2. Description of the Related

Stirling engines use, as a working gas, helium, hydrogen, or nitrogen instead of chlorofluorocarbons. It is for this reason that a Stirling engine has been receiving increasing attention as a heat engine that does not destroy the ozone layer. Examples of the Stirling engine are disclosed in Patent Documents 1 and 2.

It is a piston and a displacer that play an important role in the Stirling engine. The piston is made to reciprocate by a power source such as a linear motor, and the displacer reciprocates with a predetermined phase difference relative to the piston in synchronism therewith. The piston and the displacer make the working gas circulate between a compression space and an expansion space, thereby forming a reverse-Stirling cycle. In the compression space, the temperature of the working gas is increased by isothermal compression; in the expansion space, the temperature of the working gas is reduced by isothermal expansion. As a result, the temperature in the compression space is increased, and the temperature in the expansion space is reduced. Dissipation of heat from the compression space (the high-temperature space) through a high-temperature heat-transfer head makes it possible for the expansion space (the low-temperature space) to absorb external heat through a low-temperature heat-transfer head. This principle allows the Stirling engine to be used as a refrigerating engine.

Patent Document 1: JP-A-2004-052866 (pages 5 to 6, FIG. 1)

Patent Document 2: JP-A-2003-075005 (pages 3 to 6, FIG. 2)

SUMMARY OF THE INVENTION

In the Stirling engine, the displacer and a cylinder that receives the displacer face both the compression space (the high-temperature space) and the expansion space (the low-temperature space). If heat moves from the compression space to the expansion space through the displacer and the cylinder, the efficiency of the Stirling engine is reduced. It is for this reason that the displacer and the cylinder preferably have a structure that prevents movement of heat.

It is generally assumed that, to prevent movement of heat, the displacer and the cylinder simply have to be made of a low-thermal-conductivity material such as synthetic resin or ceramic. Incidentally, the displacer floats in the cylinder by use of a gas bearing and is made to move at high speeds. In this case, however, the use of a low-thermal-conductivity material makes it extremely difficult to achieve high dimensional accuracy required for a gas bearing. It is true that adopting a production method of adjusting, for each pair of a displacer and a cylinder, their dimensions for proper fit may make it possible to obtain a needed clearance. However, this method is not suitable for industrial mass production.

In view of the conventionally experienced problems described above, an object of the present invention is to provide a Stirling engine that effectively prevents heat from moving from a compression space to an expansion space through a displacer and a cylinder, and that permits industrial mass production thereof while offering satisfactory assembly accuracy.

To solve the above problem, according to one aspect of the present invention, a Stirling engine is provided with a piston that is made to reciprocate by a power source and a displacer that reciprocates with a predetermined phase difference relative to the piston, and causes a working gas to move between a compression space and an expansion space. Here, in parts of the displacer and a cylinder that receives the displacer, the parts located on the compression space side are made of metal, and the parts located on the expansion space side are made of a low-thermal-conductivity material having lower thermal conductivity than the metal, and the external diameter of the metal part of the displacer is greater than the external diameter of the low-thermal-conductivity material part thereof, and the internal diameter of the metal part of the cylinder is smaller than the internal diameter of the low-thermal-conductivity material part thereof.

With this construction, since, in parts of the displacer and the cylinder that receives the displacer, the parts facing the expansion space (the parts located on the expansion space side) are made of a low-thermal-conductivity material, it is possible to prevent or suppress the movement of heat from the compression space to the expansion space through the displacer and the cylinder. This enhances the efficiency of the Stirling engine. On the other hand, since, in parts of the displacer and the cylinder, the parts facing the compression space (the parts located on the compression space side) are made of metal, it is possible to achieve high heat resistance, and easily improve the fitting accuracy of the displacer and the cylinder. Thus, when a gas bearing is adopted between the displacer and the cylinder, it is possible to industrially mass-produce a product having sufficient clearance accuracy to form and maintain the gas bearing. Furthermore, since the outer diameter of the metal part of the displacer is greater than that of the low-thermal-conductivity material part thereof, and the internal diameter of the metal part of the cylinder is smaller than that of the low-thermal-conductivity material part thereof, it is possible to maintain a sufficient distance between the low-thermal-conductivity material parts having lower dimensional accuracy, and thereby prevent unexpected contact therebetween.

According to another aspect of the present invention, a Stirling engine is provided with a piston that is made to reciprocate by a power source and a displacer that reciprocates with a predetermined phase difference relative to the piston, and causes a working gas to move between a compression space and an expansion space. Here, in parts of the displacer and a cylinder that receives the displacer, the space located on the compression space side are made of metal, and the parts located on the expansion space side are made of a low-thermal-conductivity material having lower thermal conductivity than the metal, and the positional relationship (distance) between the boundary between the metal part and the low-thermal-conductivity material part of the displacer and the boundary between the metal part and the low-thermal-conductivity material part of the cylinder is set in such a way that these boundaries do not overlap each other during the reciprocating movement of the displacer.

With this construction, since the positional relationship (distance) between the boundary between the metal part and the low-thermal-conductivity material part of the displacer and the boundary between the metal part and the low-thermal-conductivity material part of the cylinder is set in such a way that these boundaries do not overlap each other during the reciprocating movement of the displacer, even if there is an unlevelness at the boundary between the metal part and the low-thermal-conductivity material part on one side and the unlevelness is so shaped as to interfere with another on the other side, these unlevelnesses do not make contact with one another and hence do not hamper the movement of the displacer.

According to the present invention, in the Stirling engine constructed as described above, a gas bearing is formed between the metal part of the displacer and the metal part of the cylinder.

With this construction, since the gas bearing is formed between the metal part of the displacer and the metal part of the cylinder, the displacer is prevented from making contact with the inner wall of the cylinder during the operation of the Stirling engine. This prevents problems from arising, such as energy loss due to friction in the area of contact, or the wearing away of the contact area.

According to the present invention, in the Stirling engine constructed as described above, in the displacer and/or the cylinder, the metal part and the low-thermal-conductivity material part are bonded together by screw-engagement and adhesive.

With this construction, in the displacer and/or the cylinder, the metal part and the low-thermal-conductivity material part are bonded together so securely that there is no possibility of the metal part and the low-thermal-conductivity material part being separated from each other.

According to the present invention, in the Stirling engine constructed as described above, in the displacer and/or the cylinder, the screw-engagement is provided in the center portion of an area where the metal part and the low-thermal-conductivity material part overlap each other, so that a thread groove is not exposed.

With this construction, in the displacer and/or the cylinder, the thread groove is not exposed. This helps prevent the thread groove from allowing the passage of the working gas.

In the Stirling engine constructed as described above, in the displacer and/or the cylinder, the adhesive may be applied to the entire perimeter of the contact surface between the metal part and the low-thermal-conductivity material part.

With this construction, the adhesive is applied to the entire perimeter of the contact surface between the metal part and the low-thermal-conductivity material part of the displacer and/or the cylinder. This makes it possible to prevent the thread groove from allowing the passage of the working gas.

In the Stirling engine constructed as described above, the low-thermal-conductivity material part may be formed by injection molding of synthetic resin.

With this construction, it is possible to mass-produce the low-thermal-conductivity material part at lower cost.

BRIEF DESCRIPTION OF DRAWINGS

First, the structure of a Stirling engine to which the present invention is applied will be described with reference to FIG. 1. FIG. 1 is a sectional view of the Stirling engine.

Figure 1:
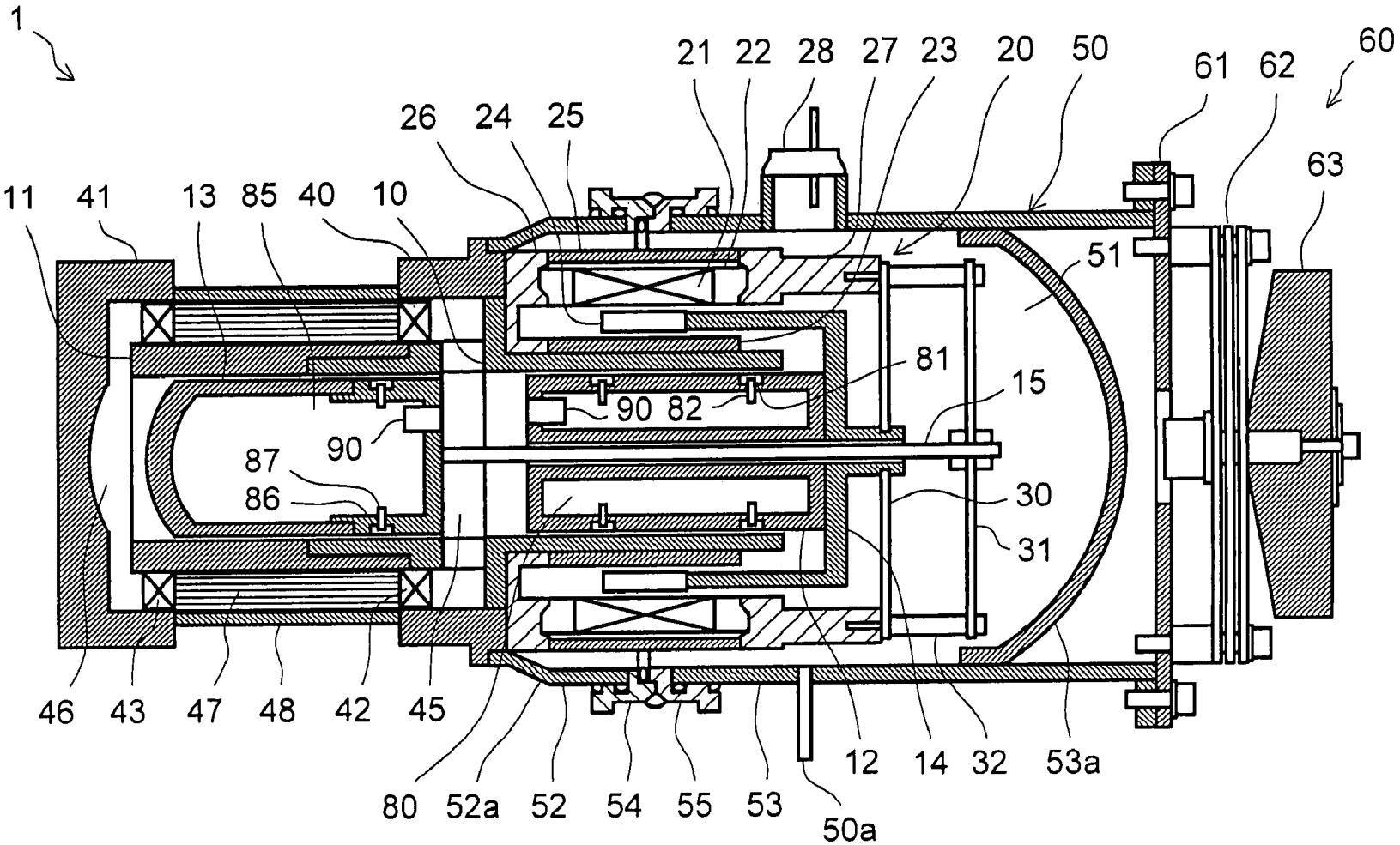
[FIG. 1] A sectional view of a Stirling engine.

A Stirling engine 1 is assembled around cylinders 10 and 11. The axis of the cylinder 10 aligns with that of the cylinder 11. The cylinder 10 has a piston 12 inserted therein, and the cylinder 11 has a displacer 13 inserted therein. When the Stirling engine 1 is operating, the piston 12 and the displacer 13 reciprocate without making contact with the inner walls of the cylinders 10 and 11 because of the presence of a gas bearing, which will be described later. The piston 12 and the displacer 13 move with a predetermined phase difference. The structures of the cylinder 11 and the displacer 13 will be described in details later.

The piston 12 has, at one end thereof, a cup-shaped magnet holder 14 fixed thereto. The displacer 13 has, at one end thereof, a displacer shaft 15 so formed as to protrude therefrom. The displacer shaft 15 penetrates the piston 12 and the magnet holder 14 in such a way that it can slidably move in the axial direction.

The cylinder 10 holds a linear motor 20 on the outside of the region where the piston 12 operates. The linear motor 20 is provided with an outer yoke 22 having a coil 21, an inner yoke 23 so formed as to be in contact with the outer circumferential surface of the cylinder 10, a ring-shaped magnet 24 that is inserted into an annular space between the outer yoke 22 and the inner yoke 23, a tubular member 25 that surrounds the outer yoke 22, and synthetic resin end brackets 26 and 27 that hold the outer yoke 22, the inner yoke 23, and the tubular member 25 in a certain relative position. The magnet 24 is fixed to the magnet holder 14.

The center of a spring 30 is fixed to the hub of the magnet holder 14, and the center of a spring 31 is fixed to the displacer shaft 15. The outer circumferential portions of the springs 30 and 31 are fixed to the end bracket 27. Between the outer circumferential portions of the springs 30 and 31, there is disposed a spacer 32, with which the springs 30 and 31 keep a certain distance between them. The springs 30 and 31 are made of a disk-shaped material having spiral grooves, making the displacer 13 resonate with a predetermined phase difference (in general, about 90°) relative to the piston 12.

There are disposed heat-transfer heads 40 and 41 on the outside of the portions of the cylinder 11, the portions corresponding to the regions where the displacer 13 operates. The heat-transfer head 40 in the shape of a ring and the heat-transfer head 41 in the shape of a cap are made of metal having high thermal conductivity such as copper or copper alloy. The heat-transfer head 40 is supported on the outer surface of the cylinder 11 with a ring-shaped internal heat exchanger 42 sandwiched therebetween, and the heat-transfer head 41 is supported thereon with a ring-shaped internal heat exchanger 43 sandwiched therebetween. The internal heat exchangers 42 and 43 are breathable, and conduct the heat of the working gas passing therethrough to the heat-transfer heads 40 and 41. The cylinder 10 and a pressure vessel 50 (body portion) are connected to the heat-transfer head 40.

An annular space surrounded by the heat-transfer head 40, the cylinders 10 and 11, the piston 12, the displacer 13, the displacer shaft 15, and the internal heat exchanger 42 serves as a compression space (a high-temperature space) 45, and a space surrounded by the heat-transfer head 41, the cylinder 11, the displacer 13, and the internal heat exchanger 43 serves as an expansion space (a low-temperature space) 46.

There is disposed a regenerator 47 between the internal heat exchangers 42 and 43. As a result of the regenerator 47 being produced by filling a container with a filling (matrix) such as metal mesh or winding a thin metal sheet or a synthetic resin film in the form of coil, the regenerator 47 has airspaces formed therein to allow the working gas to pass therethrough. The outside of the regenerator 47 is covered with a regenerator tube 48. The regenerator tube 48 establishes an airtight path between the heat-transfer heads 40 and 41.

A tubular pressure vessel that covers the linear motor 20, the cylinder 10, and the piston 12 forms a body portion 50. Inside the body portion 50, there is formed a back-pressure space 51.

The body portion 50 is structured as follows. The body portion 50 is divided into two separate portions: one of which is a ring-shaped portion 52 connected to the heat-transfer head 40; and the other of which is a cap-shaped portion 53 connected to the ring-shaped portion 52. The ring-shaped portion 52 and the cap-shaped portion 53 are both made of stainless steel. The ring-shaped portion 52 is tapered off at one end thereof so as to form a tapered portion 52*a*, which is brazed to the heat-transfer head 40. The cap-shaped portion 53 is formed by welding an end plate 53*a* to the inner surface of a pipe.

At the other end of the ring-shaped portion 52 and an opposed open end of the cap-shaped portion 53, there are disposed flange-shaped portions 54 and 55. The flange-shaped portions 54 and 55 are each formed as a stainless steel ring and are welded to the ring-shaped portion 52 and to the cap-shaped portion 53, respectively. The flange-shaped portions 54 and 55 will be finally welded together to form a sealed body portion 50.

The body portion 50 is provided with a terminal portion 28 for feeding electric power to the linear motor 20 and a pipe 50*a* for filling the body portion 50 with a working gas, both of which are so formed as to protrude radially from the outer circumferential surface of the cap-shaped portion 53.

The body portion 50 has a vibration damper 60 attached thereto. The vibration dampener 60 is built with a base 61 fixed to the body portion 50, a plate-shaped spring 62 supported by the base 61, and a mass 63 supported by the spring 62.

The piston 12*a* has a hollow space 80 inside. The hollow space 80 and the compression space 45 communicate with each other through a check valve 90 disposed in an end surface of the piston 12. On the outer circumferential surface of the piston 12, there are arranged, on the same circumference at predetermined angular intervals, a plurality of depressed portions 81 that form gas bearings. Each depressed portion 81 has, at the bottom thereof, a metal capillary tube 82 driven thereinto so as to penetrate the piston 12. Through the metal capillary tubes 82, a working gas is fed from the hollow space 80 to the depressed portions 81. There are formed two or more annular rows of depressed portions 81 at given intervals along the axis of the piston 12. That is, gas bearings are formed at two or more locations.

The displacer 13 also has a hollow space 85 inside. The hollow space 85 and the compression space 45 communicate with each other through a check valve 90 disposed in an end surface of the displacer 13. On the outer circumferential surface of the displacer 13, there are arranged, on the same circumference at predetermined angular intervals, a plurality of depressed portions 86 that form gas bearings. Through a metal capillary tube 87 driven into the bottom of each depressed portion 86, a working gas is fed from the hollow space 85 to the depressed portion 86.

The Stirling engine 1 operates as follows. When the coil 21 of the linear motor 20 is fed with an alternating-current electric power, it produces a magnetic field passing through the magnet 24 and formed between the outer yoke 22 and the inner yoke 23, making the magnet 24 reciprocate in the axial direction. By feeding electric power having a frequency corresponding to a resonant frequency that is determined based on the total mass of a piston system (the piston 12, the magnet holder 14, the magnet 24, and the spring 30) and a spring constant of the spring 30, the piston system starts to sinusoidally reciprocate smoothly.

On the other hand, a resonant frequency that is determined based on the total mass of a displacer system (the displacer 13, the displacer shaft 15, and the spring 31) and a spring constant of the spring 31 is set so as to resonate with a drive frequency of the piston 12.

The reciprocating movement of the piston 12 produces a repeated compression and expansion of the working gas inside the compression space 45. With the variation in the pressure, the displacer 13 is also made to reciprocate. At this time, the flow resistance between the compression space 45 and the expansion space 46 produces a phase difference between the displacer 13 and the piston 12. In this way, the free-piston displacer 13 vibrates with a predetermined phase difference relative to the piston 12 in synchronism therewith.

As a result of the operation described above, a reverse-Stirling cycle is formed between the compression space 45 and the expansion space 46. In the compression space, the temperature of the working gas is increased by isothermal compression; in the expansion space 46, the temperature of the working gas is reduced by isothermal expansion. As a result, the temperature in the compression space 45 is increased, and the temperature in the expansion space 46 is reduced.

When passing through the internal heat exchangers 42 and 43, the working gas that travels back and forth between the compression space 45 and the expansion space 46 during the operation conducts its heat to the heat-transfer heads 40 and 41 via the internal heat exchangers 42 and 43. The temperature of the working gas flowing from the compression space 45 into the regenerator 47 is so high that the heat-transfer head 40 is heated to become a warm head. The temperature of the working gas flowing from the expansion space 46 into the regenerator 47 is so low that the heat-transfer head 41 is cooled down to become a cold head. The heat is diffused from the heat-transfer head 40 into the atmosphere, and the temperature in a specific space is cooled down by the heat-transfer head 41. In this way, the Stirling engine 1 functions as a refrigerating engine.

The regenerator 47 allows the passage of only the working gas, and does not conduct the heat from the compression space 45 to the expansion space 46, and vice versa. When passing through the regenerator 47, the high-temperature working gas that flows from the compression space 45 into the regenerator 47 via the internal heat exchanger 42 provides heat to the regenerator 47, whereby its temperature falls, and then flows into the expansion space 46. When passing through the regenerator 47, the low-temperature working gas that flows from the expansion space 46 into the regenerator 47 via the internal heat exchanger 43 recovers heat from the regenerator 47, whereby its temperature rises, and then flows into the compression space 45. That is, the regenerator 47 serves as a thermal storage device.

The movement of the working gas as a result of the reciprocating movement of the piston 12 and the displacer 13 causes the vibration of the Stirling engine 1, which is suppressed by the vibration dampener 60.

Part of the high-pressure working gas inside the compression space 45 flows through the check valve 90 into the hollow space 80 of the piston 12 and the hollow space 85 of the displacer 13, and then jets out from the depressed portions 81 and 86. The jetting working gas forms a film of gas between the outer circumferential surface of the piston 12 and the inner circumferential surface of the cylinder 10, and between the outer circumferential surface of the displacer 13 and the inner circumferential surface of the cylinder 11, preventing contact of the piston 12 with the cylinder 10 and contact of the displacer 13 with the cylinder 11. This prevents problems from arising, such as energy loss due to friction in the area of contact, or the wearing away of the contact area.

Figure 2:
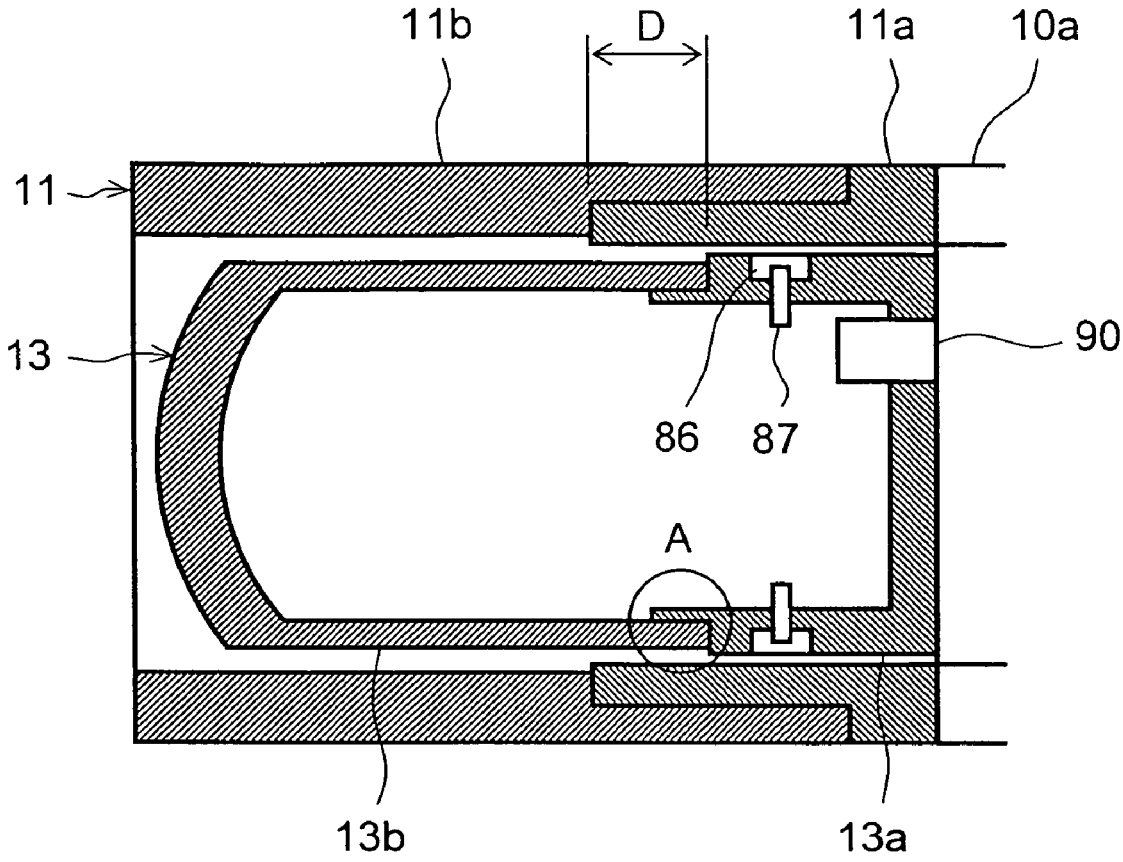
[FIG. 2] A sectional view of a displacer and a cylinder that receives the displacer.

The piston 12 and the cylinder 10 are both made of metal such as aluminum or stainless steel. On the other hand, as for the displacer 13 and the cylinder 11, part thereof is made of metal, and the remaining part thereof is made of a low-thermal-conductivity material such as synthetic resin. Hereinafter, the structure of the displacer 13 and the cylinder 11 will be described with reference to FIGS. 2 to 4. FIG. 2 is a sectional view of the displacer and the cylinder, and FIGS. 3 and 4 are enlarged sectional views showing the encircled portion A shown in FIG. 2.

In parts of the displacer 13 and the cylinder 11 that receives the displacer 13, the parts facing the compression space 45 (the parts located on the compression space side) are made of metal, and the parts facing the expansion space 46 (the parts located on the expansion space side) are made of a low-thermal-conductivity material having lower thermal conductivity than the metal. A low-thermal-conductivity material part 13*b* of the displacer 13 is fitted so as to cover a metal part 13*a* thereof, forming a socket and spigot joint. Likewise, a low-thermal-conductivity material part 11*b* of the cylinder ills fitted so as to cover a metal part 11*a* thereof, forming a socket and spigot joint. The fitting parts of these components are bonded together with adhesive. Incidentally, the fitting parts of the displacer 13, which reciprocates at high speeds, are bonded together by screw engagement and adhesion with adhesive, thereby increasing the bonding strength. FIGS. 3 and 4 show examples of screw engagement of the fitting parts of the displacer 13.

Figure 3:
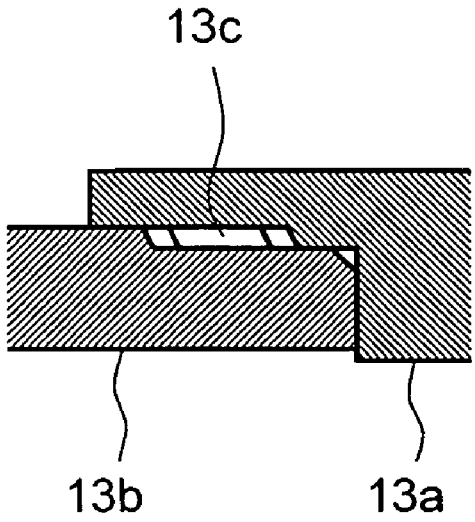
[FIG. 3] An enlarged sectional view of the encircled portion A shown in FIG. 2.
Figure 4:
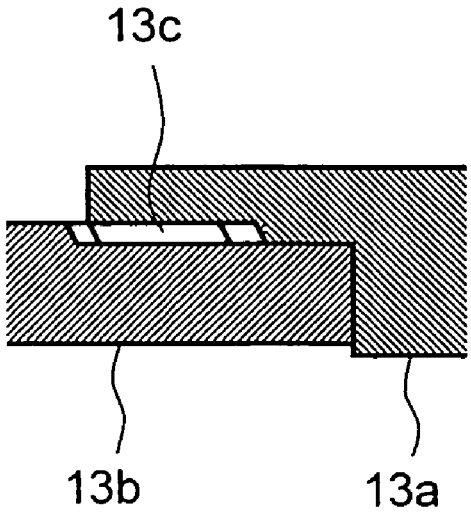
[FIG. 4] An enlarged sectional view showing an example of another structure of the encircled portion A shown in FIG. 2.

In the examples shown in FIGS. 3 and 4, a male threaded portion formed on the outer circumferential surface of the metal part 13*a* and a female threaded portion formed on the inner circumferential surface of the low-thermal-conductivity material part 13*b* constitute screw-engagement 13*c*. In the example shown in FIG. 3, the screw-engagement 13*c* is provided in the center portion of an area where the metal part 13*a* and the low-thermal-conductivity material part 13*b* overlap each other, so that a thread groove is not exposed. This helps prevent the thread groove from allowing the passage of the working gas, causing an unexpected flow (leakage) of the working gas both within and without the displacer 13.

Since the cylinder itself does not move, the metal part 11*a* and the low-thermal-conductivity material part 11*b* of the cylinder 11 can be bonded together with adequate strength with only the adhesive. However, with consideration given to the fact that the entire Stirling engine 1 vibrates with the reciprocating movement of the piston 12 and the displacer 13, screw-engagement may be provided between the metal part 11*a* and the low-thermal-conductivity material part 11*b* for greater bonding strength.

The adhesive simply has to be applied to the appropriate part of the contact surface between the metal part 13*a* and the low-thermal-conductivity material part 13*b* of the displacer 13. Application of the adhesive to the entire perimeter of the contact surface helps prevent leakage of the working gas, and application of the adhesive to the entire contact surface helps offer greater bonding strength. What has been stated above in connection with the displacer 13 equally applies to the cylinder 11.

In the displacer 13 constructed as described above, the external diameter of the metal part 13*a* is larger than that of the low-thermal-conductivity material part 13*b*. On the other hand, in the cylinder 11, the internal diameter of the metal part 11*a* is smaller than that of the low-thermal-conductivity material part 11*b*. Since a low-thermal-conductivity material has in general lower dimensional accuracy, the above-described design keeps enough distance between the low-thermal-conductivity material parts 13*b* and 11*b*, preventing unexpected contact therebetween. Even if the low-thermal-conductivity material parts 13*b* and 11*b* have high expansion coefficient, and their dimensions vary considerably with the variation in temperature, the above-described design ensures safety (prevents contact therebetween). The distance between the low-thermal-conductivity material parts 13*b* and 11*b* can be set to, for example, 120 μm.

Since the dimensional accuracy of the metal parts 13*a* and 11*a* can be improved, the fitting accuracy is defined between them, and a clearance is obtained that permits the gas bearing to function as such. This clearance can be set to, for example, 20 μm.

A distance D (see FIG. 2) between the boundary between the metal part 13*a* and the low-thermal-conductivity material part 13*b* of the displacer 13 and the boundary between the metal part 11*a* and the low-thermal-conductivity material part 11*b* of the cylinder 11 varies with the movement of the displacer 13. The positional relationship (distance) between the boundaries of the displacer 13 and the cylinder 11 is set in such a way that these boundaries do not overlap each other, that is, the distance D does not become zero. Thus, even if there is an unlevelness at the boundary between the metal part and the low-thermal-conductivity material part on one side and the unlevelness is so shaped as to interfere with another on the other side, these unlevelnesses do not make contact with one another and hence do not hamper the movement of the displacer 13.

The low-thermal-conductivity material parts 13*b* and 11*b* are formed by injection molding of synthetic resin. This makes it possible to mass-produce the low-thermal-conductivity material parts 13*b* and 11*b* at lower cost. Used as the synthetic resin is, for example, polycarbonate.

The metal part 11*a* of the cylinder 11 and the cylinder 10 are integrated together into a single member. Reference character 10*a* shown in FIG. 2 represents a bridge portion extending from the cylinder 10. With this construction, it is possible to perform positioning of the cylinders 10 and 11 with higher accuracy.

Obviously, many modifications and variations of the present invention are possible in light of the above teachings. It is therefore to be understood that within the scope of the appended claims, the invention may be practiced other than as specifically described.

INDUSTRIAL APPLICABILITY

The present invention finds wide application in Stirling engines in general.

The invention claimed is:

1. A Stirling engine comprising a piston that is made to reciprocate by a power source and a displacer that reciprocates with a predetermined phase difference relative to the piston, the Stirling engine causing a working gas to move between a compression space and an expansion space, wherein in parts of the displacer and a cylinder that receives the displacer, the parts being located on the compression space side are made of metal, and the parts being located on the expansion space side are made of a low-thermal-conductivity material having lower thermal conductivity than the metal, an external diameter of the metal part of the displacer is greater than an external diameter of the low-thermal-conductivity material part thereof, and an internal diameter of the metal part of the cylinder is smaller than an internal diameter of the low-thermal-conductivity material part thereof, and the metal part of the cylinder has an inner surface along which the metal part of the displacer reciprocates.

2. A Stirling engine comprising a piston that is made to reciprocate by a power source and a displacer that reciprocates with a predetermined phase difference relative to the piston, the Stirling engine causing a working gas to move between a compression space and an expansion space, wherein in parts of the displacer and a cylinder that receives the displacer, the parts being located on the compression space side are made of metal, and the parts being located on the expansion space side are made of a low-thermal-conductivity material having lower thermal conductivity than the metal, a distance between a boundary between the metal part and the low-thermal-conductivity material part of the displacer and a boundary between the metal part and the low-thermal-conductivity material part of the cylinder is set in such a way that these boundaries do not overlap each other during reciprocating movement of the displacer, and the metal part of the cylinder has an inner surface along which the metal part of the displacer reciprocates.

3. The Stirling engine of claim 1, wherein a gas bearing is formed between the metal part of the displacer and the metal part of the cylinder.

4. The Stirling engine of claim 1, wherein in at least one of the displacer and the cylinder, the metal part and the low-thermal-conductivity material part are bonded together by screw-engagement and adhesive.

5. The Stirling engine of claim 4, wherein the screw-engagement is provided in a center portion of an area where the metal part and the low-thermal-conductivity material part overlap each other, so that a thread groove is not exposed.

6. The Stirling engine of claim 2, wherein a gas bearing is formed between the metal part of the displacer and the metal part of the cylinder.

7. The Stirling engine of claim 2, wherein in at least one of the displacer and the cylinder, the metal part and the low-thermal-conductivity material part are bonded together by screw-engagement and adhesive.

* * * * *